US007174590B1

(12) United States Patent
Quenzi

(10) Patent No.: US 7,174,590 B1
(45) Date of Patent: Feb. 13, 2007

(54) HANDHELD MULTI-TOOL

(76) Inventor: Philip J Quenzi, 47220 Larson Rd., Atlantic Mine, MI (US) 49905

( * ) Notice: Subject to any disclaimer, the term of this patent is extended or adjusted under 35 U.S.C. 154(b) by 44 days.

(21) Appl. No.: 10/803,726

(22) Filed: Mar. 18, 2004

(51) Int. Cl.
*B25F 1/00* (2006.01)
*B26B 3/06* (2006.01)

(52) U.S. Cl. ..... 7/158; 30/160

(58) Field of Classification Search ..... 30/160, 30/161, 155; 7/158
See application file for complete search history.

(56) References Cited

U.S. PATENT DOCUMENTS

| | | | |
|---|---|---|---|
| 108,596 | A | 10/1870 | Hundley |
| 267,060 | A | 11/1882 | Buell et al. |
| 286,209 | A | 10/1883 | Lincoln |
| 311,466 | A | 2/1885 | Brokhalme |
| 315,148 | A | 4/1885 | Kriz et al. |
| 436,659 | A | 9/1890 | Harris |
| 515,742 | A | 3/1894 | von Bulzingslowen |
| 603,847 | A | 10/1898 | Harvey |
| 690,143 | A | 12/1901 | Grooms |
| 770,970 | A | 9/1904 | Keferstein |
| 812,601 | A | 2/1906 | Schrade |
| 991,316 | A | 5/1911 | Johnson |
| 1,087,342 | A | 2/1914 | Yerzley |
| 1,226,636 | A | 5/1917 | Brown |
| 1,370,995 | A | 3/1921 | Prince |
| 1,413,954 | A | 4/1922 | Ball et al. |
| 1,484,379 | A | 2/1924 | Rainey |
| 1,755,946 | A | 4/1930 | Altenbach |
| 1,805,065 | A | 5/1931 | Altenbach |
| 2,011,963 | A | 8/1935 | Altenbach ..... 7/15 |
| 2,031,044 | A | 2/1936 | Jensen et al. ..... 294/61 |
| 2,391,574 | A | 12/1945 | Housinger ..... 224/2 |
| 2,398,764 | A | 4/1946 | Bailey ..... 224/2 |

(Continued)

FOREIGN PATENT DOCUMENTS

DE 21555 6/2004

(Continued)

OTHER PUBLICATIONS

"Versatool System The Pocket Knife Redefined," 1986, Philip J. Quenzi.

(Continued)

*Primary Examiner*—Lee D. Wilson
(74) *Attorney, Agent, or Firm*—Van Dyke, Gardner, Linn & Burkhart, LLP

(57) ABSTRACT

A multi-tool includes a handle having a blade that is rotatable between open and closed positions by at least one blade rotation member mounted on the side of the handle. The blade includes two locking recesses adapted to receive a locking member mounted to a cantilevered blade lock that extends longitudinally along the handle such that the blade is securely locked in either an open or closed position. The blade rotation members rotate a cam that disengages the blade lock from the blade and imparts rotational motion to the blade by way of a drive pin located on the blade. Preferably, the multi-tool also includes an internal socket located in the handle opposite the blade end, where the socket is adapted to removably receive various tool implements. The tool implements are held in locked engagement with the handle by a cantilevered tool lock located on the handle.

31 Claims, 9 Drawing Sheets

U.S. PATENT DOCUMENTS

| | | | | |
|---|---|---|---|---|
| 2,413,082 | A | 12/1946 | Skaer | 30/125 |
| 2,466,898 | A | 4/1949 | Johnson | 30/286 |
| 2,507,019 | A | 5/1950 | Johnson | 30/151 |
| 2,528,059 | A | 10/1950 | Kendrick | 224/2 |
| 2,530,236 | A | 11/1950 | Erickson | 30/151 |
| 2,559,689 | A | 7/1951 | Truesdell | 30/151 |
| 2,695,450 | A | 11/1954 | Platts | 30/342 |
| 2,741,028 | A | 4/1956 | Carter | 30/329 |
| 2,783,536 | A | 3/1957 | McQuery | 30/151 |
| 2,793,434 | A | 5/1957 | Wigington | 30/151 |
| 2,825,374 | A | 3/1958 | Reid | 145/50 |
| 2,859,516 | A | 11/1958 | McQuery | 30/151 |
| 2,895,217 | A | 7/1959 | Fisher | 30/169 |
| 2,901,823 | A | 9/1959 | Widen | 30/151 |
| 3,621,899 | A | 11/1971 | Hula | 146/43 R |
| 3,829,967 | A | 8/1974 | Gilbert | 30/157 |
| 3,845,554 | A | 11/1974 | Joanis et al. | 30/125 |
| 3,851,986 | A | 12/1974 | Daughtry | 403/373 |
| 3,896,546 | A | 7/1975 | Hildebrandt | 30/157 |
| 3,900,950 | A | 8/1975 | Collins | 30/337 |
| 3,942,249 | A * | 3/1976 | Poehlmann | 30/160 |
| 3,974,868 | A | 8/1976 | Derbyshire | 145/24 |
| 4,011,657 | A | 3/1977 | Vance | 30/337 |
| 4,133,106 | A | 1/1979 | Addis | 30/160 |
| 4,148,140 | A | 4/1979 | Lile | 30/161 |
| 4,170,061 | A | 10/1979 | Henry | 30/160 |
| 4,177,560 | A | 12/1979 | Sakurai | 30/160 |
| 4,178,681 | A | 12/1979 | Hanses | 30/151 |
| 4,211,003 | A | 7/1980 | Collins | 30/162 |
| 4,233,737 | A | 11/1980 | Poehlmann | 30/355 |
| 4,272,887 | A | 6/1981 | Poehlmann | 30/161 |
| 4,316,324 | A | 2/1982 | Cochran | 30/162 |
| 4,404,747 | A | 9/1983 | Collins | 30/151 |
| 4,425,709 | A | 1/1984 | Quenzi | 30/151 |
| 4,531,286 | A | 7/1985 | Vito et al. | 30/2 |
| 4,541,175 | A | 9/1985 | Boyd et al. | 30/161 |
| 4,551,917 | A | 11/1985 | Walker | 30/161 |
| 4,558,516 | A | 12/1985 | Collins | 30/151 |
| 4,604,803 | A | 8/1986 | Sawby | 30/161 |
| 4,736,842 | A | 4/1988 | Uetake et al. | 206/363 |
| 4,811,486 | A | 3/1989 | Cunningham | 30/161 |
| 4,827,614 | A | 5/1989 | Mitchell | 30/151 |
| 4,835,863 | A | 6/1989 | Salandre | 30/143 |
| 4,856,192 | A | 8/1989 | Collins | 30/151 |
| 6,684,510 | B1 * | 2/2004 | Collins | 30/161 |

FOREIGN PATENT DOCUMENTS

| | | |
|---|---|---|
| GB | 355892 | 9/1931 |
| GB | 1601889 | 11/1981 |
| IT | 376938 | 11/1939 |
| SE | 47691 | 8/1919 |

OTHER PUBLICATIONS

Operating Instructions, distributed publicly Nov. 4, 1985, Philip J. Quenzi.

Drawings of Structure of Versatool System on sale for more than one year prior to Mar. 18, 2004.

* cited by examiner

HANDHELD MULTI-TOOL

BACKGROUND AND TECHNICAL FIELD OF THE INVENTION

The present invention is directed to portable knives and multi-tools, and in particular to portable, handheld style multi-tools that enable selective use of blades and various tools.

Portable handheld multi-tools enable the use of multiple working implements within a single apparatus. The multiple working implements include such equipment as pliers, wrenches, screwdrivers, and various types of cutting blades.

As compared to multiple individual tools, handheld multi-tools have numerous advantages in a wide variety of applications. Multiple individual tools can be heavy and tool kits containing such tools are often large and cumbersome. Further, such tool kits are frequently disorganized, making it difficult to find the right tool for the particular job. Handheld multi-tools, however, are much lighter in weight compared to the number of individual tools that would be equivalent to the function of the working implements of a multi-tool. In addition, because such multi-tools are designed to be handheld, they are much easier to carry than tool kits containing an equivalent number of individual tools. Handheld multi-tools are particularly useful in settings requiring tool use remote from a single location, such as on-the-road bicycle repair, or emergency tool kits for vehicles, and outdoor maintenance work.

Typically, the various working implements of handheld multi-tools are permanently pivotally mounted to the ends of the multi-tool's handle. When not in use, the working implements of such prior known multi-tools are stored in an open cavity formed between the sides of the handle. Therefore, as the number of working implements of the multi-tool increases, the size of the handle must correspondingly increase to accommodate the additional storage needs of the added working implements. In addition, a portion of the stored working implements often extends out of the storage cavity so that a user is able to grasp and pivotally open the stored working implements. The storage of the working implements within the handle is problematic because it creates a bulky multi-tool that is uncomfortable to hold. This is particularly so when portions of the stored working implements extend out of the cavity as the user must grasp an uneven surface having ridges that will dig into the user's palm or fingers.

Another problem associated with typical prior known multi-tools is the difficulty in opening the various working implements stored within the handle. In order to make such multi-tools as compact as possible, the working implements are located extremely close to one another when pivotally rotated into the storage cavity of the handle. Because of the lack of space between the stored working implements it is difficult for a user to grasp and open the desired tool with his or her thumb and forefinger. Further, in some cases the various working implements are even nested together such that in order to obtain access to a particular tool other working implements must first be rotated out of the way.

An additional problem with prior known multi-tools is the lack of locking mechanisms to prevent rotation of some or all of the various working implements. This creates a safety hazard in that rotation or slippage of a tool while in use could cause a significant injury to a user's hand or fingers.

The permanently affixed nature of the working implements of typical multi-tools is also problematic, as frequently not all of the attached implements are needed for particular activities. However, because the implements cannot be removed they must be carried at all times.

Therefore, a handheld multi-tool is needed that is easy to open, has a compact and comfortable handle, provides convenient use of the working implements, and avoids the need to rotate various working implements to gain access to a desired tool or implement.

SUMMARY OF THE INVENTION

A hand-held multi-tool according to one aspect of the present invention includes a blade pivotally mounted to a handle where the blade is rotated between an open and a closed position by at least one blade rotation member mounted on the side of the handle. The knife includes a blade lock having a locking member that selectively engages open and closed blade lock portions on the blade such that the blade is prevented from rotating when either open or closed. The blade lock is biased towards the blade and the locking member is disengaged from the open and closed blade lock portions by a cam that is connected to and driven by the at least one blade rotation member.

Another aspect of the invention is the inclusion of a drive pin on the blade of the hand-held multi-tool where the drive pin is adapted to rotate the blade when the at least one blade rotation member is rotated.

According to another aspect of the invention, the hand-held multi-tool includes a socket in the handle that is able to receive a tool insertion member. The tool insertion member includes a lead end that is inserted into the socket and an operating end that may be any one of a variety of useful tools.

According to yet another aspect of the invention, the handle of the multi-tool includes a cantilevered spring adapted to retain the tool insertion member in the socket of the handle when a tool insertion member is selectively inserted into the socket.

In a preferred application, a blade rotation member is mounted on each side of the handle of the hand-held multi-tool and enables easy and convenient opening and closing of the blade. The operational ends of the tool insertion members of the preferred embodiment include a utility blade, wrench, screwdriver, pliers and a security tang with a lanyard for convenient carrying of the entire multi-tool.

The present invention provides a compact and useful knife and multi-tool where the blade is easily opened and the blade and selected tools are securely and safely locked into desired positions. An assortment of tool insertion members may be individually and selectively inserted and removed from the multi-tool, making the invention useful for a multitude of purposes. Also, rather than having multiple tools incorporated into a single handle, the ease of tool installation and removal from the multi-tool of the present invention allows the use of compact handle that is comfortable to hold. Additionally, only the tool insertion members required for a particular activity need be carried. The present invention also, through the use of blade rotation members, on the handle exteriors, provides a convenient and easy method for opening and closing of the blade. Further, because the present invention is adapted to securely lock both the tool insertion members and the blade of the multi-tool in place when the blade is either open or closed, the danger of a tool or blade becoming loose and/or swiveling back upon the fingers or hand of the user is reduced.

DESCRIPTION OF THE PREFERRED EMBODIMENT

The present invention is embodied in a compact, versatile, and easy to use multi-tool 30. In particular, the preferred embodiment of the present invention is a pocket style multi-tool 30 that includes a knife 38 and enables the user to selectively use various tool attachments 44.

Figure 1:
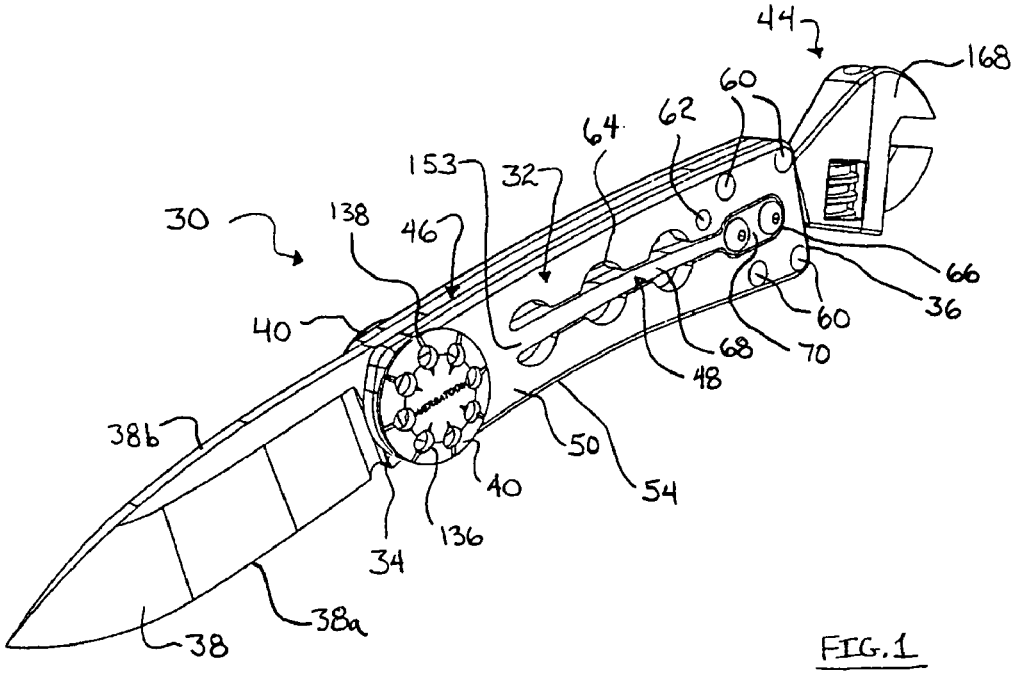
FIGS. 1 and 2 are side, perspective views of a preferred embodiment of the multi-tool of the present invention, taken from opposite sides of the invention.
Figure 2:
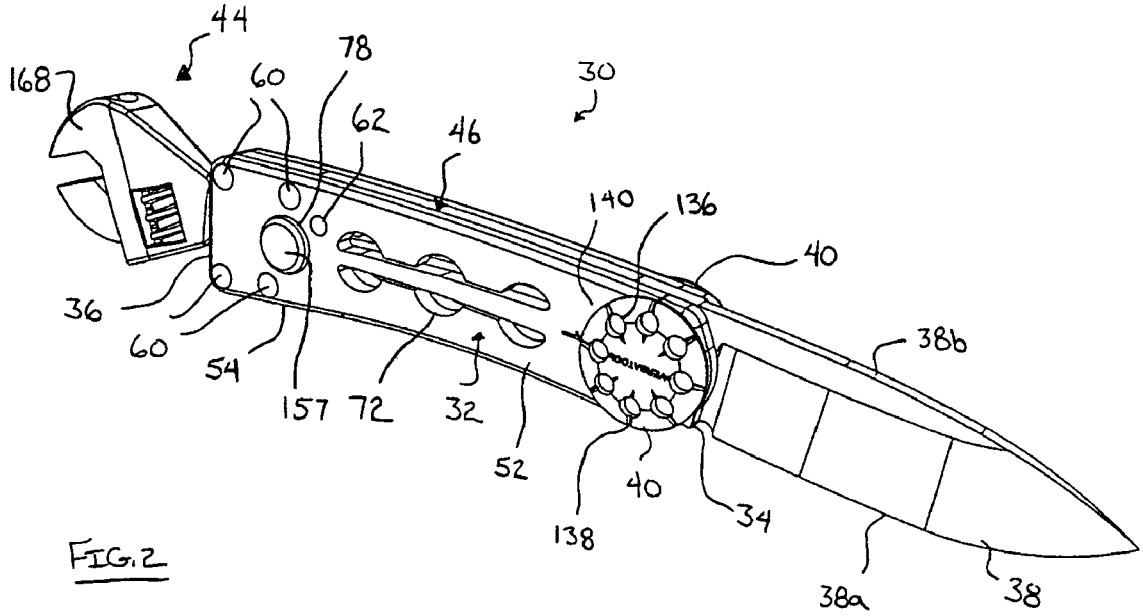

A preferred embodiment of the present invention can be seen in FIGS. 1 and 2 as multi-tool 30. Multi-tool 30 includes a handle 32 having a slotted open end 34 and a tool insertion end 36. A blade 38 that is rotatable between an open and a closed position when a user rotates blade rotation members or wheels 40 is located at the slotted open end 34. At the tool insertion end 36, an internal socket 42 is located that is able to receive a removable tool insertion member 44. Multi-tool 30 incorporates a blade lock 46 that extends the length of handle 32 and that is adapted to selectively lock blade 38 in either the open or closed position. Multi-tool 30 also includes a tool lock 48 on the side of handle 32 that retains tool insertion member 44 in socket 42 (see FIGS. 11–17).

Figure 3:
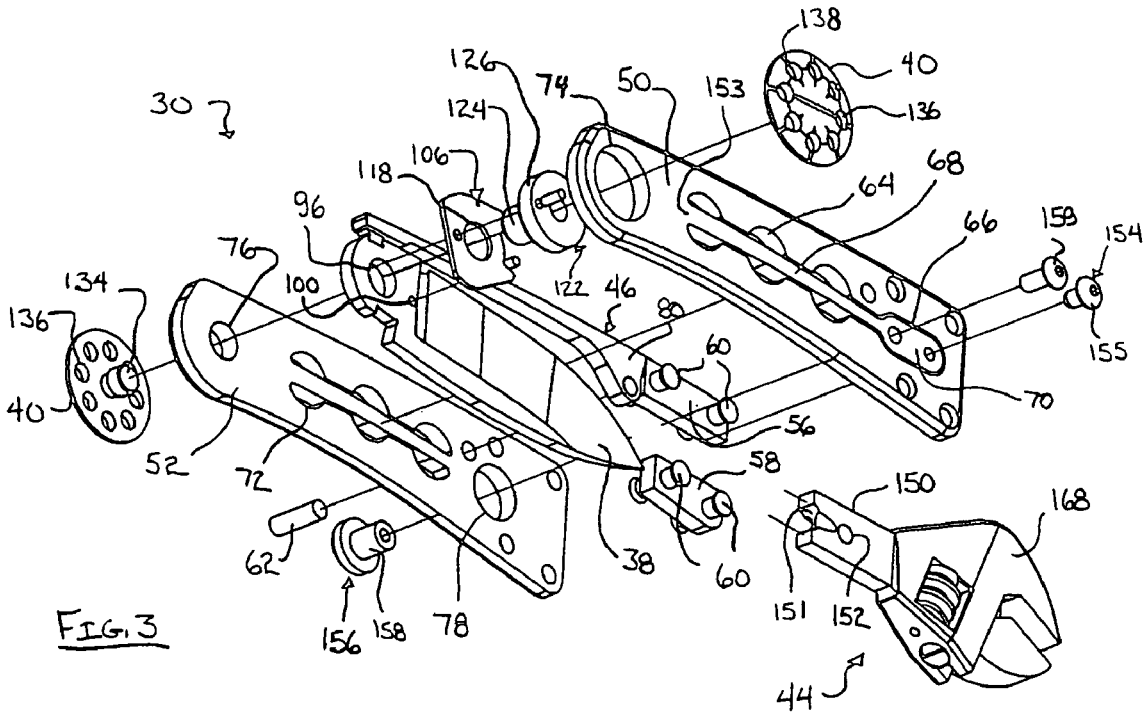
FIGS. 3 and 4 are exploded, perspective views of a preferred embodiment of the invention.
Figure 4:
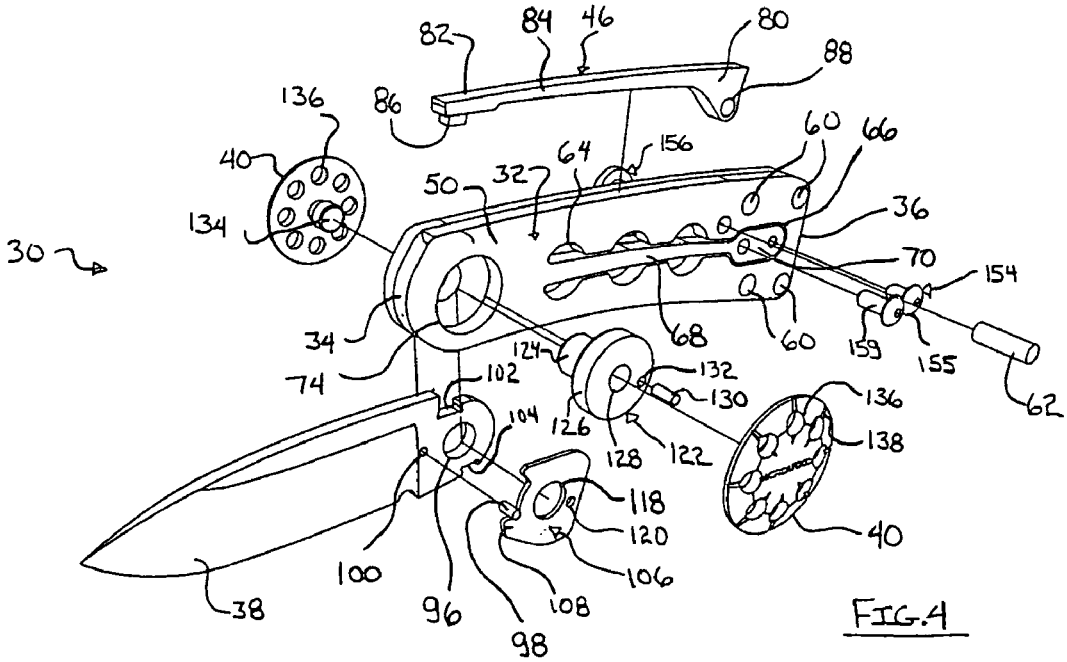

The components forming the disclosed preferred embodiment of multi-tool 30 are shown in exploded view in FIGS. 3 and 4. Handle 32 comprises first and second handle sides 50, 52 that may be made of metallic material or, alternatively, of glass-reinforced polymeric material. Handle sides 50, 52 are fixedly secured to one another to create an interior portion or slotted blade cavity 54. Cavity 54 is formed by assembling upper and lower socket spacers 56, 58 and blade lock 46 in between handle sides 50, 52. Eight fasteners 60, four per side, are used at tool insertion end 36 to attach handle sides 50, 52 to spacers 56, 58. The fasteners 60 may be rivets, screws, or the like. Spring pin 62 is used to secure blade lock 46 in between handle sides 50, 52. As will be understood from FIG. 3 and shown in FIGS. 11–17, the spacers 56, 58 are each substantially less than half the height of the handle 32 at the tool insertion end 36 such that tool insertion socket 42 is formed as an opening bounded by the spacers 56, 58 and handle sides 50, 52.

Notably, first handle side 50 includes three partially circular cutouts 64 and a tool lock head cutout 66 extending longitudinally along the length of side 50 to form the tool lock cantilever spring 68 and tool lock spring head or tool lock spring free end 70 of tool lock 48. The specific structure and manner in which tool lock 48 retains tool insertion member 44 within socket 42 will be discussed in detail below. Second handle side 52 also includes three partial circular cutouts 72 that are formed to match the appearance of cutouts 64. In addition to forming portions of tool lock 48 and creating a uniform appearance of handle sides 50, 52, cutouts 64, 72 function to reduce the overall weight of multi-tool 30 and act as gripping aids when using multi-tool 30.

Handle 32 also includes two mounting holes, pivot pin support hole 74 and shaft hole 76, that are located at slotted open end 34 and rotatably receive the components that function to retain and rotate blade 38. Pivot pin support hole 74 is located on first handle side 50 and shaft hole 76 is located on second handle side 52. In addition, second handle side 52 includes release button hole 78 located near tool insertion end 36.

Figure 6:
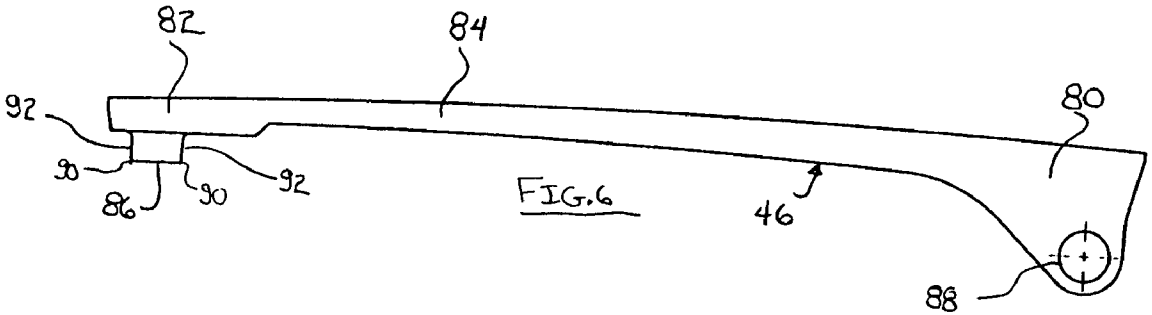
FIG. 6 is a side, elevational view of the blade lock of the preferred embodiment.
Figure 7:
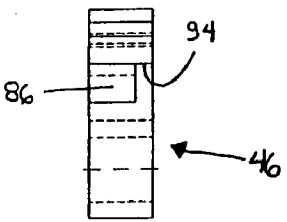
FIG. 7 is a front view of the blade lock of FIG. 6.

Blade lock 46, as noted, extends along the length of handle 32 and is contained between first and second handle sides 50, 52 by spring pin 62. As best seen in FIG. 6, blade lock 46 comprises a blade spring fixed end 80, a blade spring free end 82, a blade cantilever spring arm 84, a locking member or pawl 86, and a blade lock hole 88. In the embodiment shown in FIG. 6, blade locking member 86 is disclosed as having a generally rectangular form. In this embodiment, blade locking member 86 has radiused corners 90 and a tapered profile whereby, in the view shown, faces 92 are angularly converging in a downward direction. FIG. 7 reveals that blade locking member 86 is offset to one side of blade lock 46 such that a cam acting surface 94 is included on blade lock 46.

When assembled to handle 32, as understood from FIGS. 3 and 4, spring pin 62 passes through blade lock hole 88 such that blade spring free end 82 is located at slotted open end 34 of multi-tool 30 and blade spring fixed end 80 is located proximate the tool insertion end 36. As is understood from FIGS. 11–15, blade cantilever spring arm 84 is able to upwardly flex as blade lock 46 is only secured at blade spring fixed end 80 by spring pin 62. Blade lock 46 does not pivot about spring pin 62 as a rear portion of blade lock 46 contacts upper spacer 56. In the preferred embodiment, blade lock 46 is made of metallic material, but may also be made of a durable plastic material.

As also disclosed in FIGS. 3 and 4, a cam 106 and pivot pin 122 are assembled to the slotted open end 34 of handle 32, along with blade 38 and rotation members 40.

Figure 5:
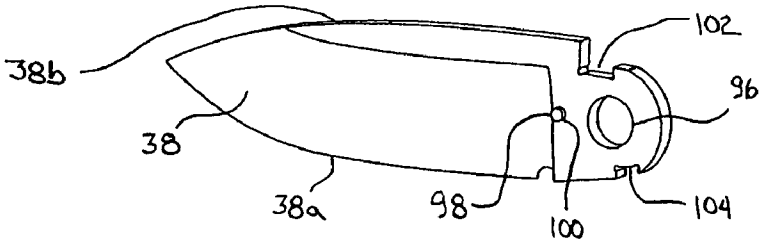
FIG. 5 is a perspective view of the blade of the preferred embodiment.

Blade 38 is made of metallic material and, as is typical of knife blades, includes a sharp edge 38*a* for cutting that extends longitudinally out to a point and a back edge 38*b* that is wider and dull relative to the sharp edge. As shown in FIG. 5, blade 38 includes a blade center hole or blade mounting hole 96, and a blade drive pin 98 inserted into blade pin hole 100. In addition, blade 38 includes generally rectangular shaped open and closed blade lock portions or recesses 102, 104. The open and closed blade lock portions 102, 104 are not diametrically opposed from each other. That is, as seen in FIG. 5, the open blade lock portion 102 is located left of the center point of blade mounting hole 96 and the closed blade lock portion 104 is located right of the center point of mounting hole 96.

As best seen in FIGS. 11–15, cam 106 includes opening and closing cam prongs 108, 110 that are circumferentially spaced a predetermined distance or limited arc 112 from each other on one hemi-circle of cam 106. Cam 106 also includes opening and closing cam shoulders 114, 116 that are circumferentially spaced from each other on the hemi-circle opposite that containing cam prongs 108, 110. In addition, cam 106 includes cam center hole 118 and cam drive pin hole 120. As designed, cam 106 is well adapted to be formed as a stamped or laser cut part and, therefore, is preferably made of metallic material.

As shown in FIGS. 3 and 4, pivot pin 122 includes pivot pin shaft 124 and bearing surface 126 that form connected concentric, cylindrical sections. An internally threaded through hole 128 is located along the centerline of pivot pin shaft 124 and bearing surface 126. In addition, pivot pin 122 includes cam drive pin 130 that is press fit into pivot pin hole 132. The thickness of bearing surface 126 is approximately equivalent to the width of first handle side 50. Further, bearing surface 126 has a diameter that is slightly less than the diameter of pivot pin support hole 74 in handle side 50 and pivot pin shaft 124 has a diameter that is slightly less than shaft hole 76 in handle side 52. When assembled, pivot pin 122 is rotatably received within pivot pin support hole 74 and shaft hole 76 and functions as a bearing. Therefore, in a preferred embodiment, pivot pin 122 is constructed of a metallic material suitable for bearing applications, such as a brass alloy. Alternatively, pivot pin 122 could be made from a different metallic material, such as steel, or from a durable plastic material.

With reference to FIGS. 1–4, each blade rotation member 40 includes an inwardly directed threaded post 134 and multiple, circumferentially spaced, through holes 136 located radially outwardly from the center of the member, each hole having a grip channel 138 associated therewith extending radially outwardly to the outer edge of the member. As disclosed, the blade rotation members 40 have an outer diameter that is approximately equivalent to the height of the handle 32 at the slotted open end 34 (see FIGS. 1 and 2). The blade rotation members 40 are formed to have a generally conical profile with a flat top. Through holes 136 are radially positioned at the location where the generally conical surface meets the generally flat top. As will be better understood below, a user opens and closes blade 38 by manually rotating blade rotation members 40. Therefore, the outwardly located through holes 136 and grip channels 138 act as gripping aids and enable the user to apply the required opening and closing torque to blade 38. The blade rotation members 40 could be made from a metallic material, for example a brass or steel alloy, or from a durable plastic material.

As disclosed in FIGS. 3 and 4, cam 106, pivot pin 122, blade 38, and blade rotation members 40 are all mounted at slotted open end 34 of handle 32. When so assembled, the blade rotation members 40, pivot pin 122, and cam 106 are interconnected to each other and to blade 38 such that during operation, as discussed below, rotary motion of the blade rotation members 40 pivotally opens and closes blade 38.

Assembly of blade 38, cam 106, pivot pin 122, and blade rotation members 40 to handle 32 is as follows: Blade 38 and cam 106 are oriented together such that blade drive pin 98 is located within cam prongs 108, 110. Blade 38 and cam 106 are then placed in between left and right handle sides 50, 52 at slotted open end 34. Next, pivot pin 122 is inserted through pivot pin support hole 74 such that pivot pin shaft 124 passes through both the blade mounting hole 96 and cam center hole 118, and such that cam drive pin 130 engages cam pin hole 120. In this orientation, bearing surface 126 is contained within pivot pin support hole 74 of first handle side 50 and the distal end of pivot pin shaft 124 is contained within shaft hole 76 of second handle side 52 such that blade 38 and cam 106 are mounted intermediate handle sides 50, 52 on shaft 124. Finally, blade rotation members 40 are fastened to either end of pivot pin 122 by threading their respective threaded posts 134 into both ends of threaded through hole 128. As the diameter of the blade rotation members 40 is larger than the diameter of both the pivot pin support hole 74 and shaft hole 76, the blade rotation members 40 constrain the pivot pin 122 within handle 32, and the blade 38 and cam 106 are thereby retained within the slotted open end 34. In this arrangement, the blade rotation members 40 are located on the exterior portion 140 of handle 32, and the blade 38, cam 106, and pivot pin 122 are pivotally contained in the interior portion 54 of handle 32.

Figure 11:
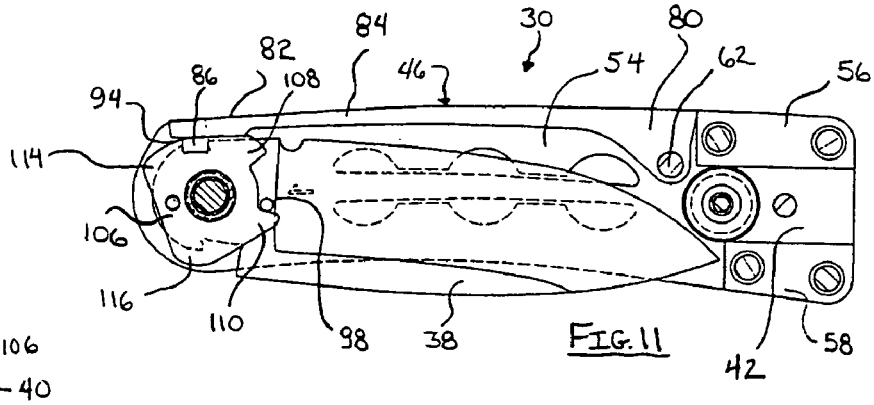
FIGS. 11–15 are side, elevational views along the line B—B of FIG. 10 showing the blade in various stages of opening, beginning with the fully closed position in FIG. 11 and progressing successively to the fully open position in FIG. 15.
Figure 15:
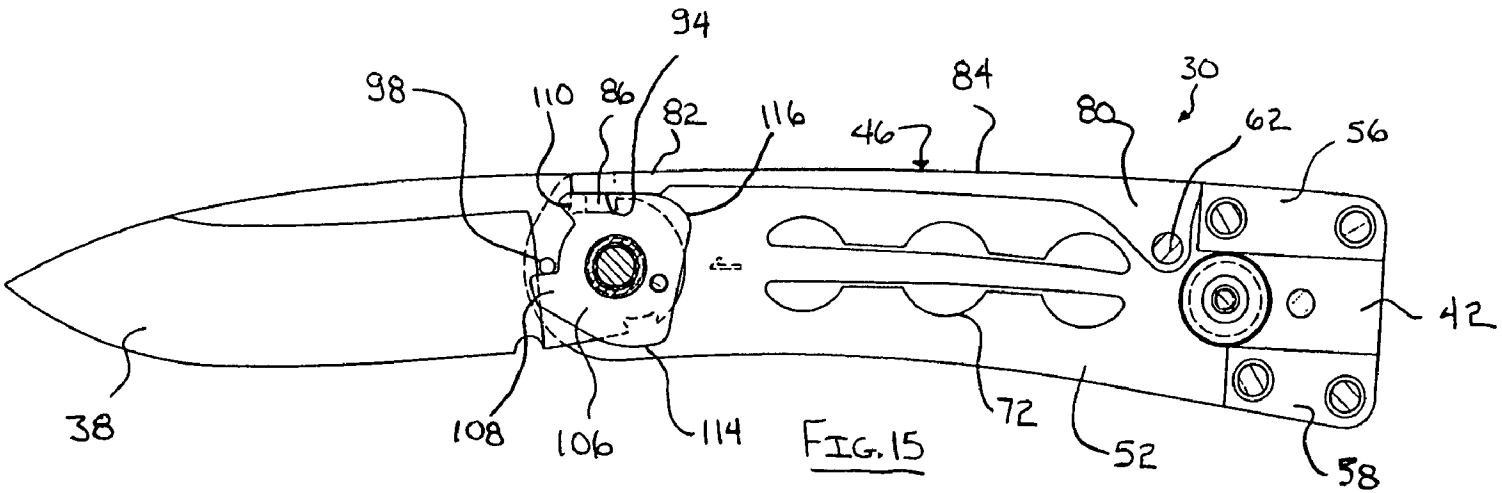

When blade 38 is assembled to slotted open end 34 of handle 32 in the manner described above, the generally rectangular open and closed blade lock portions 102, 104, are positioned such that they are able to receive the generally rectangular blade locking member 86 of blade lock 46. As shown in FIGS. 11 and 15, the open and closed blade lock portions 102, 104, selectively receive blade locking member 86 when blade 38 is placed in either an open or closed position. In the open position of FIG. 15, blade 38 is fully extended for use. In the closed position of FIG. 11, blade 38 is nestably contained within the slotted blade cavity 54 of handle 32. Blade 38 becomes positively locked when the blade locking member 86 is engaged with either the open or closed blade lock portions 102, 104, such that blade 38 is not able to rotate. This is significant in that blade 38 will not accidentally open or close, which is a safety hazard when working with a sharp blade. Once blade 38 is positively locked, in order to rotate blade 38 the blade locking member 86 must be disengaged from the open or closed blade lock portion 102, 104.

Figure 10:
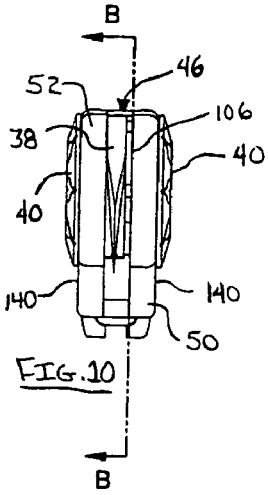
FIG. 10 is a front, elevational view of the slotted open end of the preferred embodiment.

In the preferred embodiment, blade locking member 86 is disengaged from open and closed blade lock portions 102, 104 by cam 106. As previously noted and shown in FIG. 7, which is a frontal view of blade lock 46, cam acting surface 94 is located just to the right of blade locking member 86. As understood from FIG. 10, which is a frontal view of assembled multi-tool 30, cam 106 is positioned just to the right of blade 38 in between first and second handle sides 50, 52. When blade lock 46 and cam 106 are assembled to multi-tool 30, blade lock 46 is, therefore, located above cam 106 such that cam 106 is positioned just to the right of blade locking member 86 and directly below cam acting surface 94.

Figure 12:
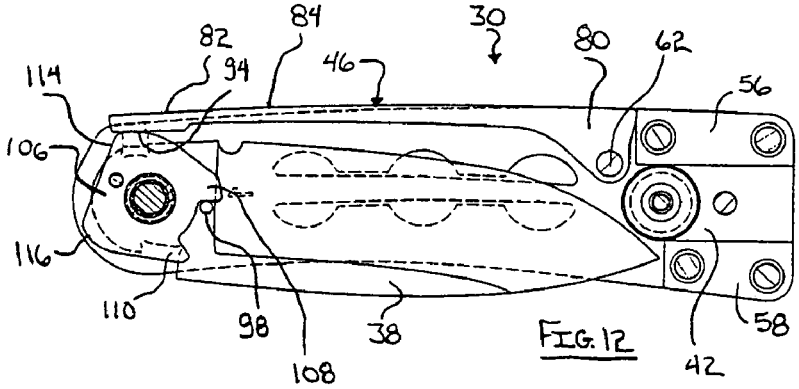
Figure 13:
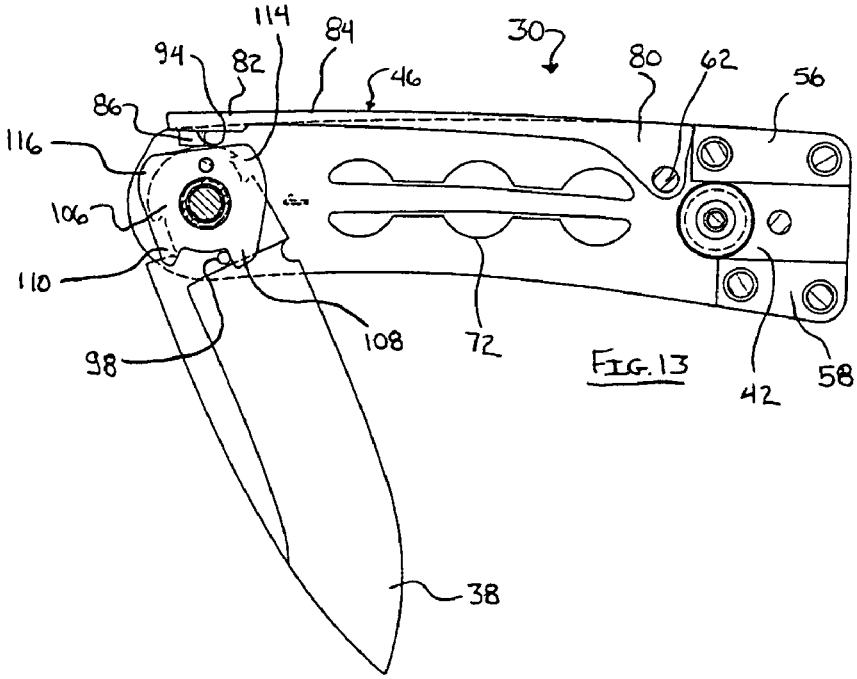

When cam 106 is rotated clockwise with respect to the view shown in FIG. 11, cam opening shoulder 114 acts on cam acting surface 94, thus raising blade cantilever spring arm 84 and disengaging blade locking member 86 from closed blade lock portion 104 as shown in FIG. 12. Conversely, cam closing shoulder 116 would disengage blade locking member 86 from open blade lock portion 102 by raising blade lock 46 if cam 106 were rotated counter-clockwise with respect to the view shown in FIG. 15. The radiused corners 90 and tapered faces 92 of blade locking member 86 facilitate the engagement of blade locking member 86 with open and closed blade lock portions 102, 104.

Cam 106 also functions to open and close blade 38 by imparting rotational force to blade drive pin 98. When cam 106 is rotated clockwise with respect to the views shown in FIGS. 12–15, opening cam prong 108 imparts a clockwise rotational force to blade drive pin 98, thereby opening blade 38. Conversely, closing cam prong 110 would impart a counter rotational force to drive pin 98 if cam 106 were rotated counter-clockwise with respect to the view shown in FIG. 15, such that blade 38 would be rotated to a closed position. FIG. 11 discloses the position of closing cam prong 110 relative to drive pin 98 when blade 38 has just been closed, showing closing prong 110 in contact with blade drive pin 98 and blade locking member 86 contained within closed blade lock portion 104.

Figure 14:
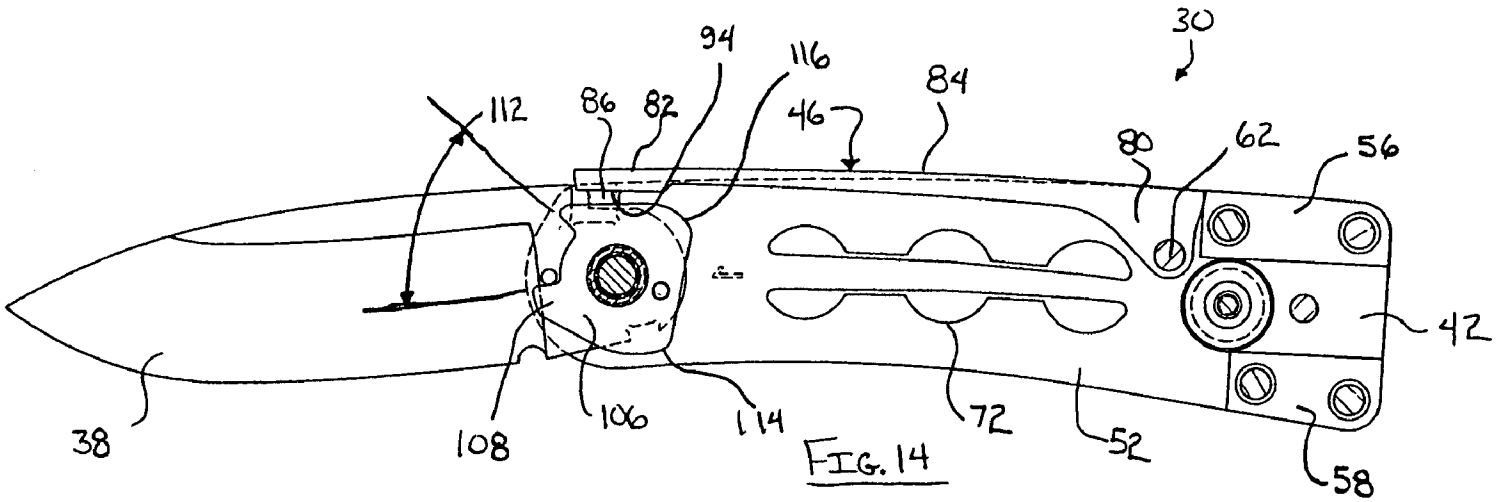

As previously noted, and best seen in FIG. 14, opening and closing cam prongs 108, 110 are circumferentially spaced a predetermined distance or limited arc 112, which in the preferred embodiment is approximately 40 degrees. The limited arc 112 enables cam 106 to rotate the approximately 40 degrees without cam prongs 108, 110 engaging blade drive pin 98. Thus, opening or closing of blade 38 is delayed with respect to contact of cam prongs 108, 110 with blade drive pin 98. FIGS. 11 and 12 disclose that cam shoulders 114, 116 and cam prongs 108, 110 are oriented relative to one another such that when cam 106 is rotating through the predetermined distance and opening cam prong 108 is not engaging blade drive pin 98, opening shoulder 114 is able to raise blade cantilever spring arm 84 and disengage blade locking member 86 from closed blade lock portion 104. Once blade locking member 86 is disengaged, opening cam prong 108 engages blade drive pin 98 and blade 38 is rotated. Similarly, it can be seen in FIG. 15 that if cam 106 were rotated counter-clockwise, cam closing shoulder 116 would disengage blade locking member 86 from open blade lock portion 102 prior to closing cam prong 110 engaging blade drive pin 98.

The blade rotation members 40 impart rotational motion to cam 106 in the following manner. The blade rotation members 40 are fixedly secured to pivot pin 122 by the threaded connection of threaded posts 134 to through hole 128. In turn, pivot pin 122 is fixedly secured to cam 106 by engagement of cam drive pin 130 with cam drive pin hole 120. Therefore, the blade rotation members 40, pivot pin 122, and cam 106 may be simultaneously rotated. Because blade 38 is rotatably supported on pivot pin shaft 124, when pivot pin 122 and cam 106 are rotated by blade rotation members 40, cam shoulders 114, 116 will disengage blade locking member 86 from open and closed blade lock portions 102, 104 and cam prongs 108, 110 will thereafter come into driving contact with blade drive pin 98 and rotate blade 38 as previously discussed.

The positioning of blade rotation members 40 on either side of the exterior portion 140 of handle 32 enables simple, convenient opening and closing of blade 38. To open blade 38, the blade rotation members 40 are grasped between the thumb and index finger of one hand and, while firmly holding the blade rotation members 40, handle 32 is rotated relative to the rotation members 40 such that cam 106 disengages blade lock 46 and drives blade 38 to an open position. Handle 32 must be rotated relative to blade 38 until blade locking member 86 falls into place inside open blade lock portion 102. Alternatively, a multi-tool 30 user can achieve one-handed blade 38 opening by firmly grasping blade rotation members 40 and then snapping his or her wrist such that the momentum of handle 32 causes cam 106 to disengage blade lock 46 from the closed blade lock portion 104 and drive blade 38 to an open position. To close blade 38, the blade rotation members 40 are grasped firmly with the thumb and index finger of one hand and handle 32 is rotated in a direction counter to that for opening. Handle 32 can be rotated in this manner by either moving it with the opposite hand or by placing handle 32 against a fixed object.

Figure 8:
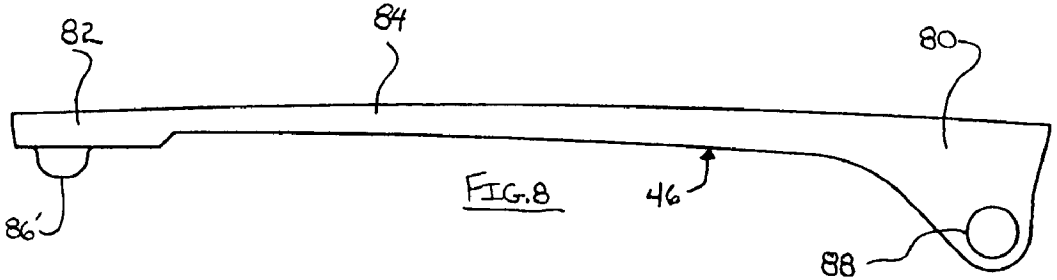
FIG. 8 is an alternative embodiment of the blade lock of FIG. 6.

An alternative embodiment of blade locking member 86 is shown as generally circular shaped pawl 86' in FIG. 8. Although not shown, the corresponding recess for such a pawl would likewise be generally circular shaped. As can be understood, various pawl and recess shapes could be used as long as the function of locking blade 38 is obtained. For instance, in another alternative embodiment, the open and closed blade lock portions on blade 38 could be protruding detents and the locking member could be a recess adapted to receive the detents.

Figure 9:
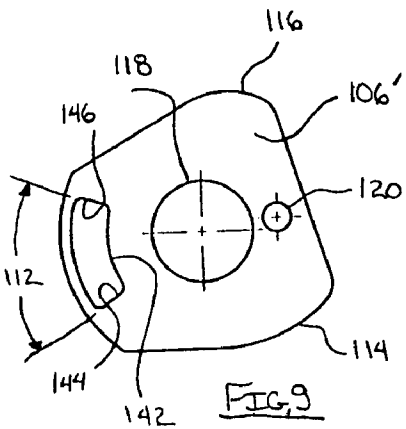
FIG. 9 is a side, elevational view of an alternative embodiment of the cam.

An alternative embodiment of cam 106 is disclosed in FIG. 9 as slotted cam 106'. Slotted cam 106' includes opening and closing cam shoulders 114, 116 as well as driving slot 142. Driving slot 142 has opening drive surface 144 and closing drive surface 146 that function in the same manner as cam prongs 108, 110 discussed above. In operation, blade drive pin 98 is contained within slot 142 and opening drive surface 144 acts on drive pin 98 to open blade 38. Conversely, closing drive surface 146 acts on drive pin 98 to close blade 38. The opening and closing drive surfaces 144, 146 are circumferentially spaced a predetermined distance 112 such that slotted cam 106' is able to rotate over a limited arc of approximately 40 degrees without driving blade 38, which enables blade locking member 86 to be disengaged from either the open or closed blade lock portions 102, 104 via shoulders 114, 116.

Although not shown in the figures, pivot pin 122 and cam 106 could alternatively be formed as a single part. In such an embodiment, the opening and closing cam prongs 108, 110 and cam opening and closing shoulders 114, 116 would be integrally formed with the bearing surface 126 and pivot pin shaft 124.

Figure 16:
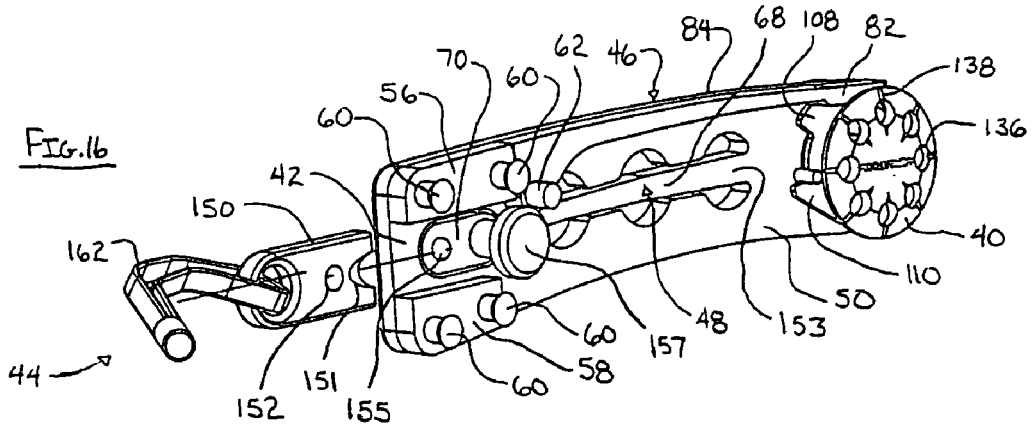
FIG. 16 is a perspective view of the multi-tool of the present invention with the blade and one side of the handle removed to show the tool insertion socket of the preferred embodiment.
Figure 17:
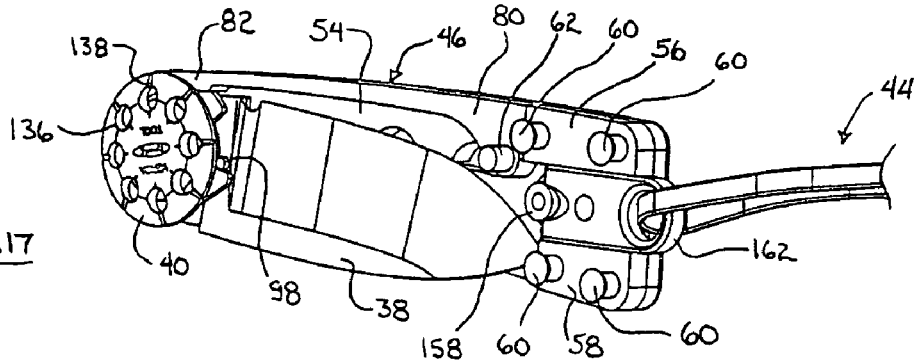
FIG. 17 is a side, perspective view of the multi-tool taken from the side opposite that in FIG. 16 with the opposite side of the handle from that in FIG. 16 removed and showing a tool insertion member inserted into the tool insertion socket.
Figure 18:
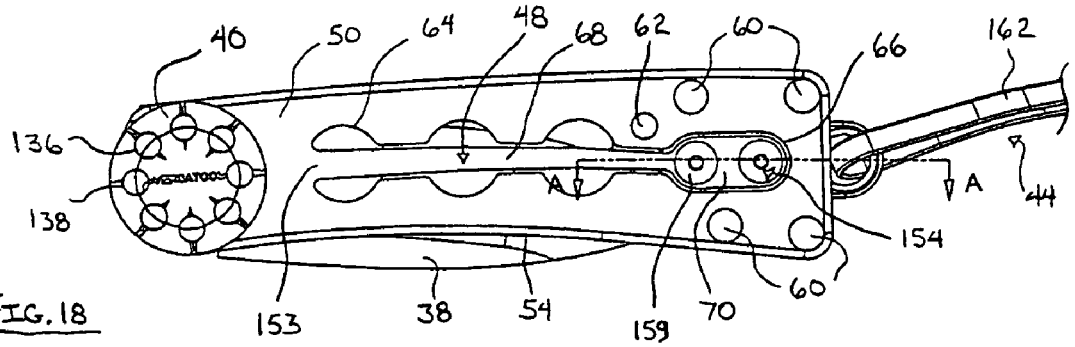
FIG. 18 is a side, elevational view of a preferred embodiment of the multi-tool with the blade in the fully closed position and a tool insertion member inserted into the tool insertion socket.

As noted above, the tool insertion end 36 of handle 32 includes an internal socket 42 that selectively receives a tool insertion member 44. FIG. 16 discloses that the first handle side 50, an upper socket spacer 56, a lower socket spacer 58, and the second handle side 52, which for clarity is not shown in FIG. 16, define the tool insertion socket 42. The tool insertion member 44 has a lead end 150 and an operational end that is shown in FIG. 16 as a security tang with a lanyard 162. In this view, the tool insertion member 44 is shown prior to being inserted into socket 42. FIG. 17 shows the security tang with lanyard 162 inserted into socket 42 with first handle side 50 removed for clarity. Unlike pivotally rotatable tool connections on typical multi-tools, socket 42 of multi-tool 30 does not allow tool insertion members 44 to rotate. This is significant because the risk of a tool inadvertently rotating back upon the hand or fingers of a user is therefore reduced.

Figure 19:
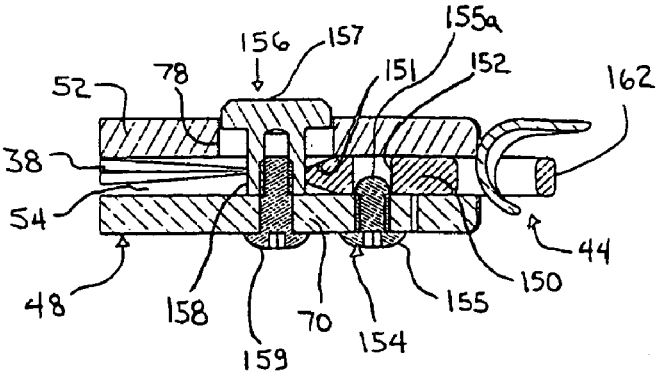
FIG. 19 is a sectional view along the line A—A of FIG. 18.
Figure 20:
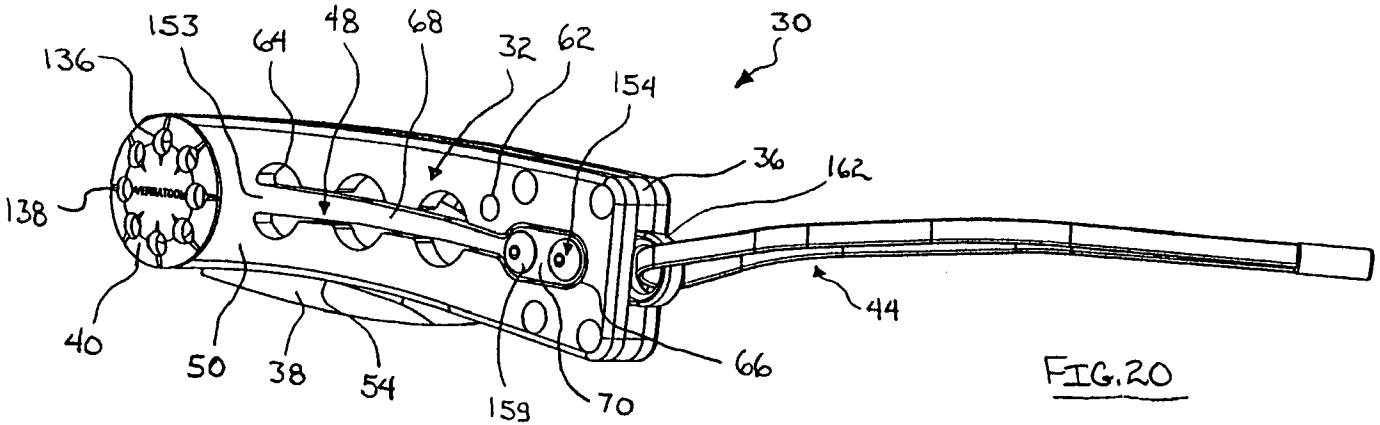
FIGS. 20–25 are perspective views showing various tool insertion members inserted into the tool insertion socket of the preferred embodiment.

As best understood from FIGS. 16 and 19, a tool insertion member 44 is retained in socket 42 by tool lock 48. As discussed above, tool lock 48 is formed in first handle side 50 and comprises tool lock cantilever spring 68, tool lock spring fixed end 153, and a tool lock spring free end or tool lock spring head 70. In addition, attached to tool lock spring head 70 of tool lock 48 is a tool lock member 154 and a release button 156. The release button 156 has a button head 157 and a button shaft 158. In the preferred embodiment, the tool lock member 154 is a spherical head screw 155 that is fastened to tool lock spring head 70 such that, as shown in FIG. 19, the spherical head 155*a* extends out of and beyond the inside surface of tool lock spring head 70. The release button 156 is attached to tool lock spring head 70 by threaded fastener 159. The release button head 157 extends out of the release button hole 78 of second handle side 52 when release button 156 is attached to tool lock spring head 70 and first and second handle sides 50, 52 are secured together.

With reference to FIGS. 16, 17, and 19, the lead end 150 of a tool insertion member 44 includes two C-shaped, bilateral concave cam surfaces or ramps 151 and a tool lock hole 152. The lead end 150 has a generally rectangular cross section and, as mentioned, is adapted to fit within the tool insertion socket 42. When lead end 150 of tool insertion member 44 is inserted into socket 42, the bilateral concave ramps 151 function to lift the spherical head of screw 155. Upon further insertion, the spherical head of screw 155 is biased by tool lock cantilever spring arm 68 into engagement with tool lock hole 152. Engagement of tool lock hole 152 by the spherical head of screw 155 locks tool insertion member 44 in socket 42 such that insertion member 44 will not inadvertently fall out. The bilateral orientation of the concave ramps 151 enables the tool insertion member 44 to be inserted in either of two orientations, 180 degrees relative to one another. As also seen in FIG. 19, the C-shaped profile of the lead end 150 of tool insertion member 44 is adapted to partially encircle cylindrical button shaft 158 when inserted into socket 42.

The spherical head of screw 155 must be removed from tool lock hole 152 in order to remove an installed tool insertion member 44 from socket 42. As shown in FIG. 2, button head 157 extends through release buttonhole 78 of second handle side 52. As can be understood from FIG. 19, depressing release button 156 flexes tool lock cantilever spring 68 such that the spherical head of screw 155 is disengaged from tool lock hole 152 and the tool insertion member 44 contained within socket 42 may then be removed.

Figure 21:
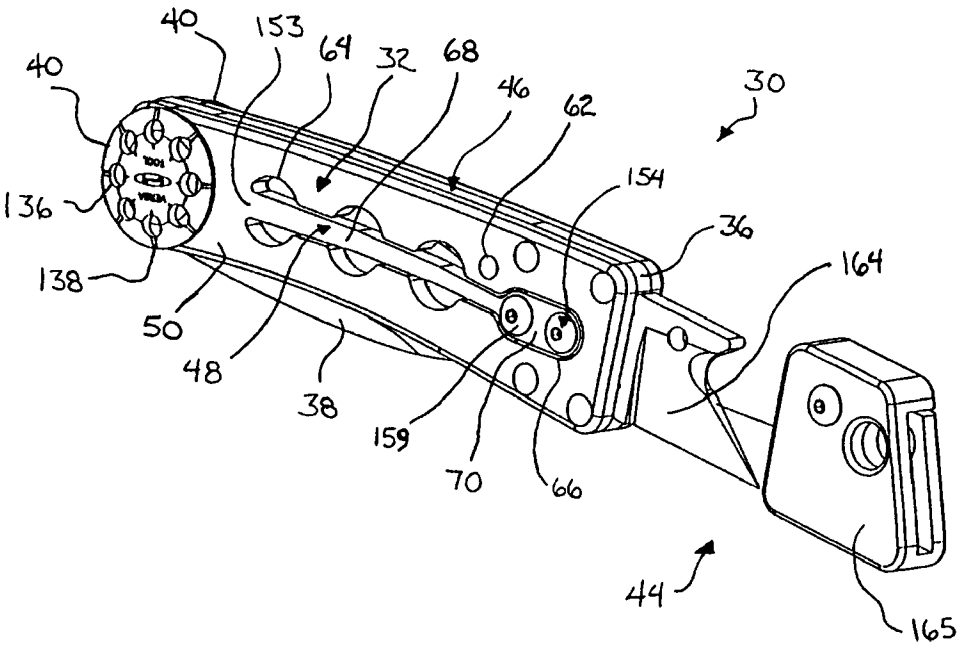
Figure 22:
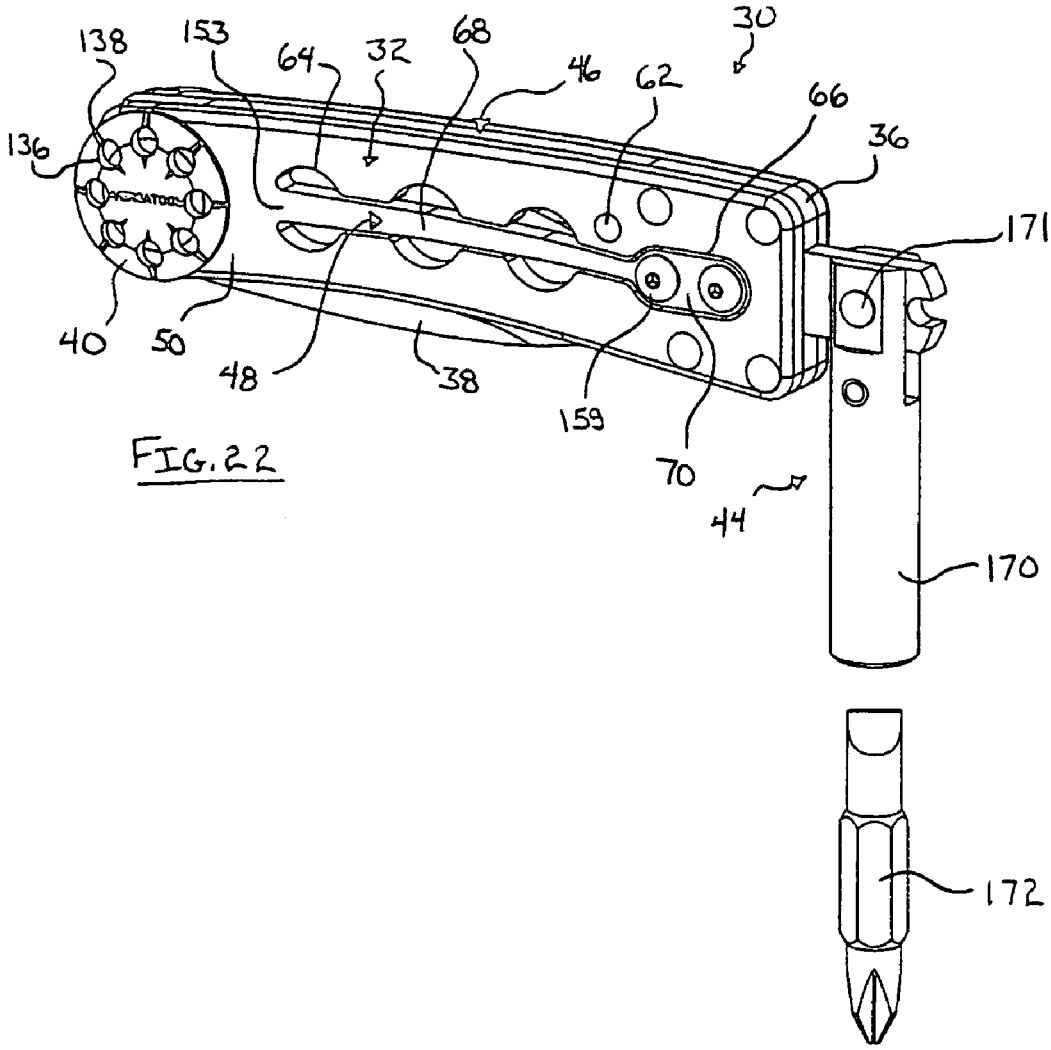
Figure 23:
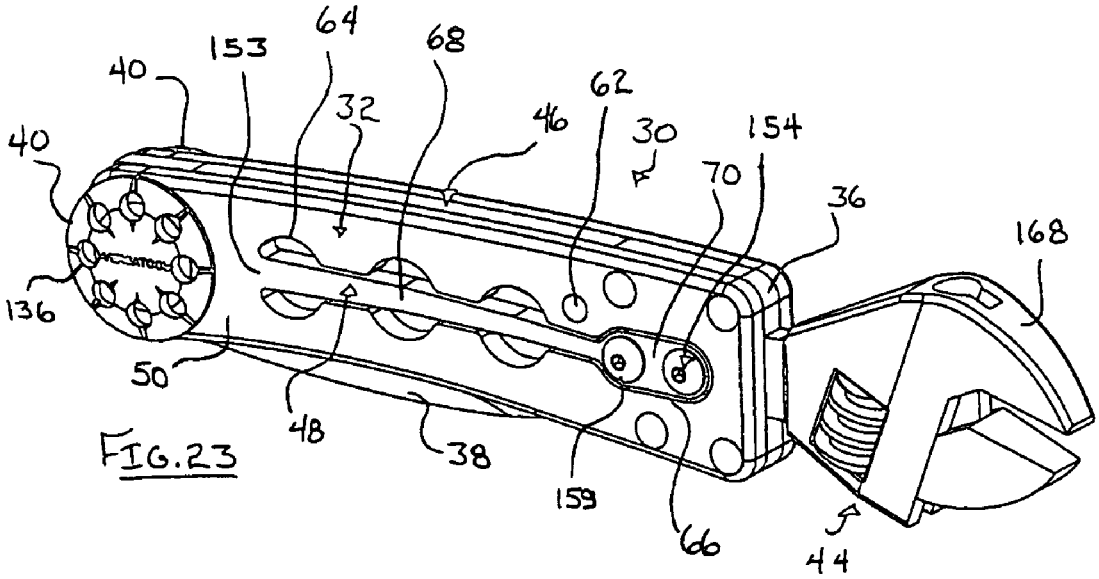
Figure 24:
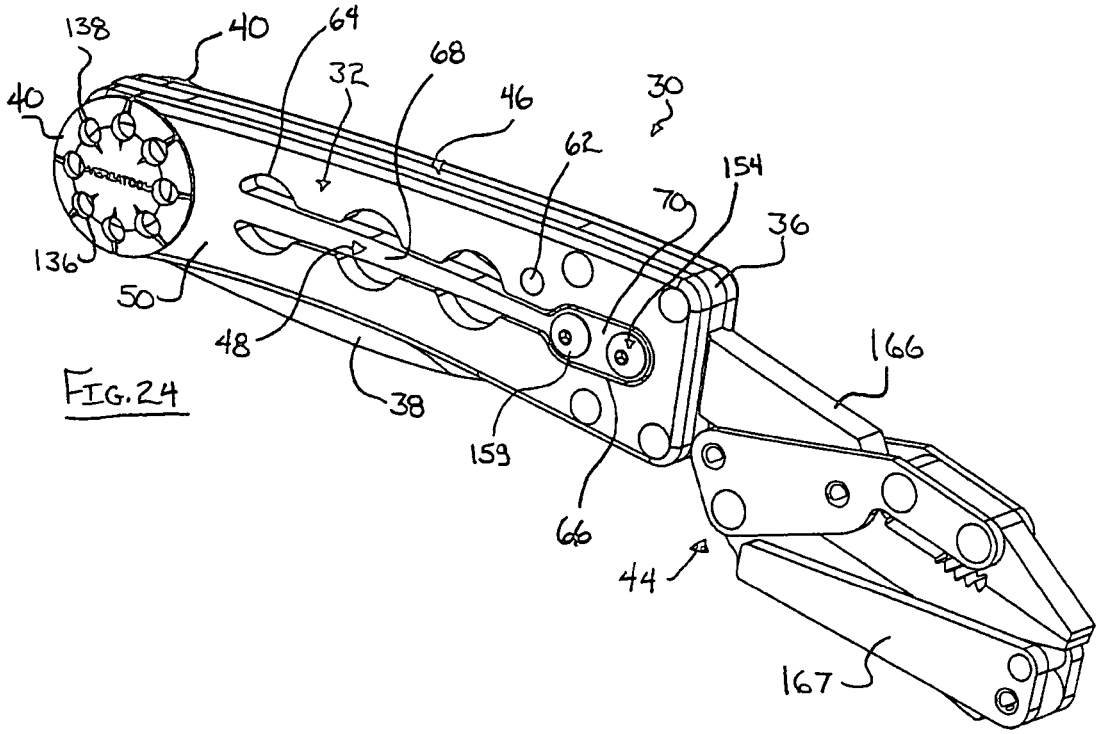
Figure 25:
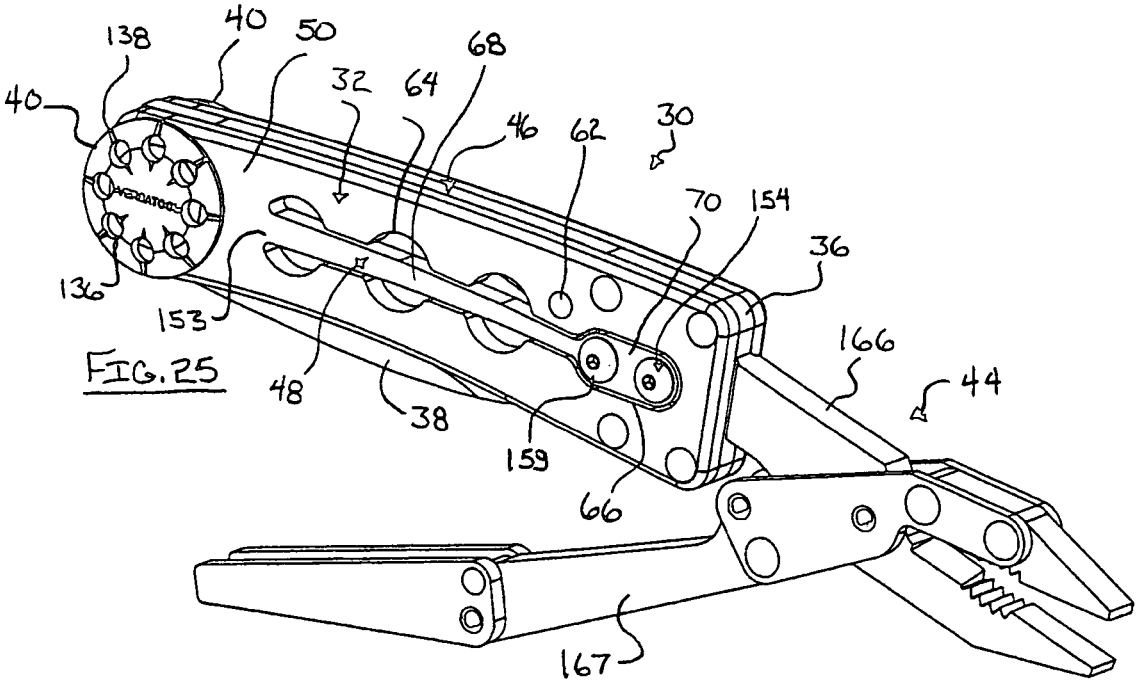

The handheld multi-tool 30 enables many different types of tool insertion members 44 to be inserted into socket 42. FIGS. 20–25 disclose tool insertion members 44 where the operational end is a utility blade 164, pliers 166, wrench 168, screwdriver 170, or the security tang with lanyard 162. FIG. 21 shows that when the utility blade 164 is inserted into socket 42, it may be covered with cap 165 when not in use. FIGS. 24 and 25 disclose that when the pliers 166 are inserted into multi-tool 30, handle 167 is able to fold over upon itself, enabling easy storage when not in use. FIG. 22 discloses that the screwdriver member 170 can be angled at joint 171 for improved torque. Additionally, the screwdriver 170 is able to accept reversible style bits 172, such as slotted or Phillips, in a receiving socket at the outer end of the screw-driver. When not in use, the compact nature of the various tool insertion members 44 allows them to be conveniently stored and transported in a portable carrying case (not shown) or in the user's pocket, for example.

The ability to selectively insert and remove an assortment of tool insertion members 44 makes the multi-tool 30 of the present invention useful for a variety of purposes. Rather than having a multiplicity of tools incorporated into a single handle, the present invention enables easy tool installation and removal from a compact handle 32. As such, the handle 32 is not as bulky or cumbersome as conventional multi-tools 30 and is more comfortable to hold. Additionally, only the tool insertion members 44 required for a particular activity need be carried. Further, the blade rotation members 40 provide a convenient method for opening and closing of blade 38. Finally, because both the tool insertion members 44 and the blade 38 of the multi-tool 30 are adapted to be securely locked in place, the danger of a blade 38 or tool swiveling back upon the fingers or hand of the user is reduced.

The above is a description of the preferred embodiments. One skilled in the art will recognize that changes and modifications may be made without departing from the spirit of the disclosed invention, the scope of which is to be determined by the claims which follow and the breadth of interpretation that the law allows.

The invention claimed is:

1. A knife comprising:

a handle;

a rotatable blade pivotally mounted to said handle;

a blade lock having a blade locking member;

at least one blade rotation member mounted on one side of said handle for opening and closing said blade;

a cam connected to and driven by said at least one blade rotation member, said cam adapted to contact said blade lock for engaging and disengaging said blade locking member with said blade;

said blade having an open blade lock portion and a closed blade lock portion, wherein said blade locking member is selectively receivable by said open blade lock portion and said closed blade lock portion for securing said blade, said blade lock being biased such that said blade locking member is urged toward one of said open and closed blade lock portions, and wherein said cam disengages said blade locking member from said closed blade lock portion when opening said knife and disengages said blade locking member from said open blade lock portion when closing said knife.

2. The knife of claim 1, wherein said blade locking member is a pawl, and said open and closed blade lock portions are recesses.

3. The knife of claim 1, wherein said cam includes two cam shoulders, one cam shoulder being an opening shoulder, and the second cam shoulder being a closing shoulder.

4. The knife of claim 1, wherein said handle comprises a first handle side and a second handle side, wherein said first and second handle sides form a slotted blade cavity when said first handle side is attached to said second handle side.

5. The knife of claim 4, wherein said handle has a slotted open end, said rotatable blade being mounted to said handle at said slotted open end.

6. The knife of claim 1, wherein said blade lock is a cantilevered spring, said cantilevered spring having a blade spring fixed end and a blade spring free end distal to said blade spring fixed end, wherein said blade locking member is attached to said blade spring free end.

7. The knife of claim 6, wherein said blade locking member comprises a pawl, said open and closing blade lock portions being recesses, said locking pawl being generally rectangular shaped and said open and closed blade lock recesses being generally rectangular shaped and adapted to receive said locking pawl, wherein said generally rectangular shaped locking pawl has tapered faces and radiused corners.

8. The knife of claim 1, wherein said at least one blade rotation member includes a plurality of circumferentially spaced through holes to aid in gripping said at least one blade rotation wheel.

9. The knife of claim 1, wherein said handle is made from metallic material.

10. The knife of claim 1, wherein said handle is made from glass reinforced polymeric material.

11. The knife of claim 1, including two blade rotation members for opening and closing said blade, wherein said handle has a first handle said and a second handle side and one of said blade rotation members is mounted on said first handle side, and the second said blade rotation member is mounted on said second handle side.

12. A knife comprising:

a handle;

a rotatable blade pivotally mounted to said handle;

a blade lock having a blade locking member;

at least one blade rotation member mounted on one side of said handle for opening and closing said blade;

a cam connected to and driven by said at least one blade rotation member, said cam adapted to contact said blade lock for engaging and disengaging said blade locking member with said blade;

said blade having an open blade lock portion and a closed blade lock portion, wherein said blade locking member is selectively receivable by said open blade lock portion and said closed blade lock portion for securing said blade, said blade lock being biased such that said blade locking member is urged toward one of said open and closed blade lock portions, and wherein said cam disengages said blade locking member from said closed blade lock portion when opening said knife and disengages said blade locking member from said open blade lock portion when closing said knife;

wherein said blade includes a drive pin on said blade, and said cam includes at least one cam prong for rotating said blade by driving said drive pin.

13. The knife of claim 12, wherein said cam includes two cam shoulders, one cam shoulder being an opening shoulder, and the second cam shoulder being a closing shoulder.

14. The knife of claim 13, wherein said cam includes an opening cam prong and a closing cam prong, wherein said opening cam prong opens said blade by driving said drive pin in a blade opening direction, and wherein said closing cam prong closes said blade by driving said drive pin in a rotation opposite to that for opening.

15. The knife of claim 14, wherein said opening cam prong and said closing cam prong are circumferentially spaced such that said cam is able to rotate a predetermined distance before one of said cam prongs engages said drive pin.

16. The knife of claim 15, wherein said predetermined distance is approximately 40 degrees.

17. A knife comprising:

a handle;

a rotatable blade pivotally mounted to said handle;

a blade lock having a blade locking member;

at least one blade rotation member mounted on one side of said handle for opening and closing said blade;

a cam connected to and drive by said at least one blade rotation member, said cam adapted to contact said blade lock for engaging and disengaging said blade locking member with said blade;

said blade having an open blade lock portion and a closed blade lock portion, wherein said blade locking member is selectively receivable by said open blade lock portion and said closed blade lock portion for securing said blade, said blade lock being biased such that said blade locking member is urged toward one of said open and closed blade lock portions, and wherein said cam disengages said blade locking member from said closed blade lock portion when opening said knife and disengages said blade locking member from said open blade lock portion when closing said knife;

wherein said blade includes a drive pin on said blade, and said cam includes a slot for rotating said blade by driving said drive pin.

18. The knife of claim 17, wherein said slot has opening and closing drive surfaces for engaging said drive pin surface.

19. The knife of claim 18, wherein said opening surface is circumferentially spaced a predetermined distance from said closing drive surface.

20. The knife of claim 19, wherein said predetermined distance is approximately 40 degrees.

21. A knife comprising:

a handle;

a rotatable blade pivotally mounted to said handle;

a blade lock having a blade locking member;

at least one blade rotation member mounted on one side of said handle for opening and closing said blade;

a cam connected to and driven by said at least one blade rotation member, said cam adapted to contact said blade lock for engaging and disengaging said blade locking member with said blade;

said blade having an open blade lock portion and a closed blade lock portion, wherein said blade locking member is selectively receivable by said open blade lock portion and said closed blade lock portion for securing said blade, said blade lock being biased such that said blade locking member is urged toward one of said open and closed blade lock portions, and wherein said cam disengages said blade locking member from said closed blade lock portion when opening said knife and disengages said blade locking member from said open blade lock portion when closing said knife;

further including a pivot pin connecting said cam and said at least one blade rotation member, wherein said handle includes a pivot pin support hole on one side of said handle, said pivot pin being rotatably supported within said blade pivot pin support hole.

22. The knife of claim 21, wherein said pivot pin has an internally threaded through hole and said at least one blade rotation member has an externally threaded post, whereby said at least one blade rotation member is securely threadably fastened to said pivot pin.

23. The knife of claim 22, wherein said blade rotation member is a wheel.

24. The knife of claim 22, wherein said pivot pin includes a cam drive pin and said cam has a cam pin hole, wherein said cam drive pin engages said cam through said cam pin hole and causes said cam to rotate when said at least one blade rotation wheel is rotated.

25. A knife comprising:

a handle;

a rotatable blade pivotally mounted to said handle, said blade having at least one blade lock portion;

a blade lock having a blade locking member, said blade locking member being receivable by said at least one blade lock portion for securing said blade, said blade lock being biased such that said blade locking member is urged toward said at least one blade lock portion;

at least one blade rotation member mounted on one side of said handle for opening and closing said blade;

a cam connected to and driven by said at least one blade rotation member, said cam adapted to contact said blade lock for engaging and disengaging said blade locking member with said at least one blade lock portion;

said blade having a drive pin, wherein said drive pin is adapted to be contacted by said cam and rotate said blade when said at least one blade rotation member is rotated.

26. The knife of claim 25, wherein said blade includes an open blade lock portion and a closed blade lock portion, and said cam includes two cam shoulders and two cam prongs, said cam shoulders adapted to engage and disengage said blade locking member from said blade lock portion, and said cam prongs are adapted to rotate said blade by driving said drive pin.

27. The knife of claim 25, wherein said blade includes an open blade lock portion and a closed blade lock portion, and said cam includes two cam shoulders and a cam slot, said cam shoulders adapted to engage and disengage said blade lock from said blade lock portions, and said cam slot is adapted to rotate said blade by driving said pin.

28. The knife of claim 25, wherein said blade lock is a cantilevered spring, said cantilevered spring having a fixed end and a free end distal to said fixed end, wherein said blade locking member is attached to said free end.

29. The knife of claim 28, wherein said blade locking member is a pawl, and said at least one blade lock portion is a recess.

30. The knife of claim 25, wherein said handle has a blade end and a tool insertion end distal to said blade end, said blade being mounted to said blade end, and said tool insertion end of said handle being adapted to receive a tool insertion member.

31. The knife of claim 30, wherein said tool insertion member is selected from the group consisting of a security tang with lanyard, utility blade, pliers, wrench, and screwdriver.

* * * * *

UNITED STATES PATENT AND TRADEMARK OFFICE

CERTIFICATE OF CORRECTION

PATENT NO. : 7,174,590 B1
APPLICATION NO. : 10/803726
DATED : February 13, 2007
INVENTOR(S) : Philip J. Quenzi It is certified that error appears in the above-identified patent and that said Letters Patent is hereby corrected as shown below:

Column 7
Line 46, After "manner" "." should be --:--

Column 11
Line 11, "said" should be --side--

Column 11
Line 61, "drive" should be --driven--

Column 13
Line 16, "portion" should be --portions--

Signed and Sealed this
Twenty-fifth Day of September, 2012

David J. Kappos

David J. Kappos
*Director of the United States Patent and Trademark Office*